US006070990A

United States Patent [19]

Dalton et al.

[11] Patent Number: 6,070,990

[45] Date of Patent: Jun. 6, 2000

[54] CARD LIGHT HAVING A COVER BEING AN ADHESIVELY ATTACHED LABEL

[75] Inventors: David R. Dalton, Westlake, Ohio; Peter F. Lynch; David A. Furth, both of Skaneateles, N.Y.

[73] Assignee: Eveready Battery Company, Inc., St. Louis, Mo.

[21] Appl. No.: 08/850,693

[22] Filed: May 2, 1997

[51] Int. Cl.[7] ..... F21L 7/00

[52] U.S. Cl. ..... 362/201; 362/189; 362/200; 235/487

[58] Field of Search ..... 235/487, 488, 235/441, 491, 444; 362/200, 201, 189

[56] References Cited

U.S. PATENT DOCUMENTS

| | | | |
|---|---|---|---|
| 3,758,773 | 9/1973 | Nau | 362/189 |
| 4,250,539 | 2/1981 | Leitzel et al. | 362/200 |
| 4,409,645 | 10/1983 | Sloan | 362/200 |
| 4,644,451 | 2/1987 | Chabria | 362/200 |
| 4,692,846 | 9/1987 | Johnson | 362/104 |
| 4,731,712 | 3/1988 | Amthor | 362/189 |
| 4,739,455 | 4/1988 | Pullman | 362/200 |
| 5,158,356 | 10/1992 | Guthrie | 362/188 |
| 5,386,351 | 1/1995 | Tabox | 362/201 |
| 5,457,613 | 10/1995 | Vandenbelt | 362/200 |
| 5,463,539 | 10/1995 | Vandenbelt | 362/189 |
| 5,585,618 | 12/1996 | Droz | 235/488 |
| 5,763,868 | 6/1998 | Kubota et al. | 235/488 |
| 5,927,846 | 7/1999 | Sinclair | 362/189 |

*Primary Examiner*—Donald Hajec
*Assistant Examiner*—Daniel St.Cyr
*Attorney, Agent, or Firm*—Robert W. Welsh

[57] ABSTRACT

A card light assembly comprising a generally flat polymeric tray having inner and outer surfaces and a pair of ends, a peripheral rim on the inner surface, an electrochemical cell-receiving recess in the inner surface, and a LED-receiving recess at one of the ends, an annular electrical separator and a disc-type electrochemical cell in the cell receiving recess, a LED in said LED-receiving recess, the LED having two leads, one of which is in abutment with the cell and the other of which is spaced from the cell by the separator. A pressure sensitive adhesive label extends over the inner surface, and over the cell, and is adhered to the housing inner surface to thereby retain the separator and cell within the assembly. At least one of the tray and label is flexibly depressible at the separator and cell for pressing the other lead against the cell to temporarily energize the LED.

11 Claims, 3 Drawing Sheets

CARD LIGHT HAVING A COVER BEING AN ADHESIVELY ATTACHED LABEL

BACKGROUND OF THE INVENTION

This invention relates to card lights, and particularly to a disposable flashlight of credit card size to readily fit within a wallet or purse for use in finding items or to see things up close.

The concept of having a small light to be as close as possible in size to that of a credit card has been proposed previously, but achieving this objective is not readily accomplished. Perhaps the closest someone has come in this regard is taught in U.S. Pat. No. 5,457,613. However, the many layers of material there required to be employed leaves much to be desired, both as to economical manufacture of the light and as to convenience of fit within a wallet.

SUMMARY OF THE INVENTION

An object of this invention is to provide a credit card size disposable light of simple yet effective structure. The novel light has two basic enclosure elements, one being a polymeric, generally rigid, rectangular tray or plate element and the other being a self adhesive label layer. These two function to retain a disc-type cell, a small separator on the cell serving as a switch component, and a light source with leads, one of which serves as another part of the switch. The light source is shown as a LED (light emitting diode).

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
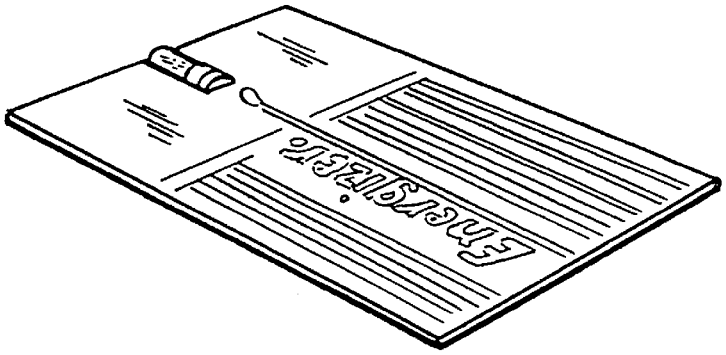
FIG. 1 is a perspective view of the complete card light.

Referring now specifically to the drawings, the complete card light assembly 10 is shown to be composed of only five elements, namely the tray type housing 12, the disc battery 30, a LED 36, an insulation wafer 44 in the form of an annulus, and a pressure sensitive adhesive label 20 which also serves to hold the components 30 and 44 in the assembly.

Figure 3:
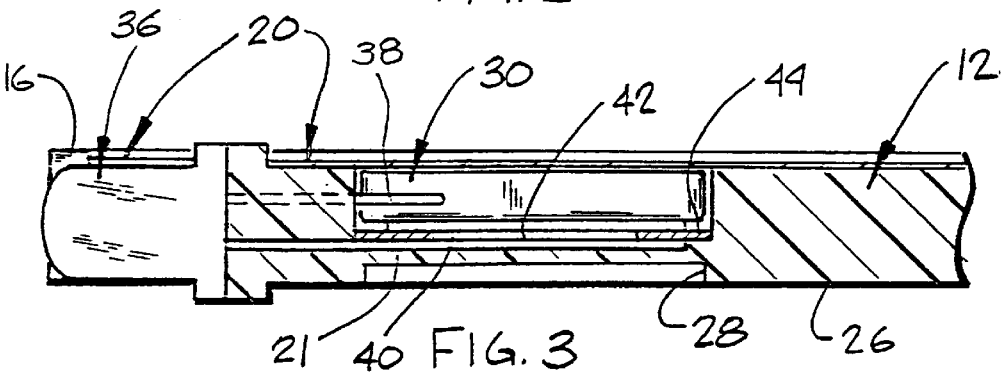
FIG. 3 is a cross sectional fragmentary view of the card light.
Figure 4:
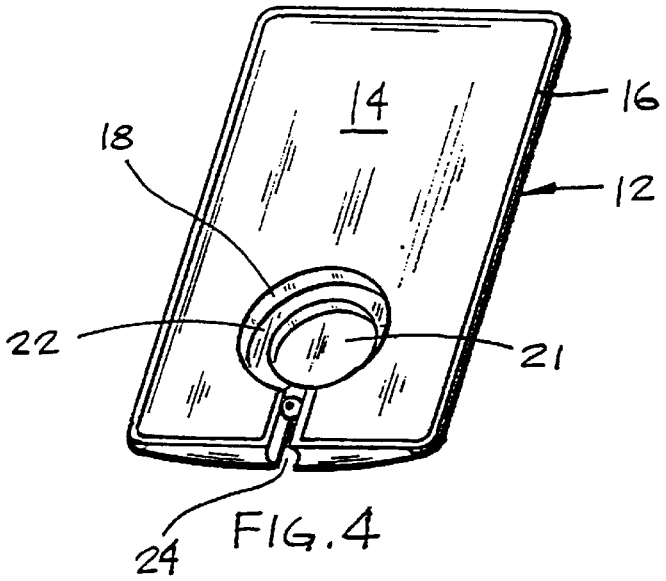
FIG. 4 is a perspective view of the housing or tray forming the base of the light.
Figure 5:
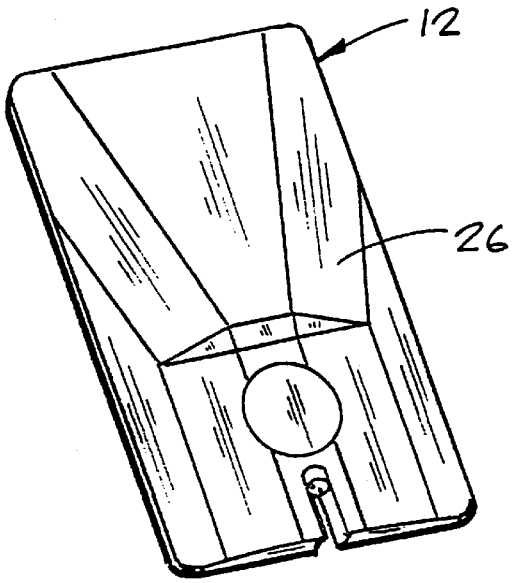
FIG. 5 is a perspective bottom view of the tray.
Figure 6:
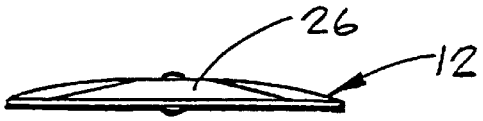
FIG. 6 is an end elevational view of the tray.
Figure 7:
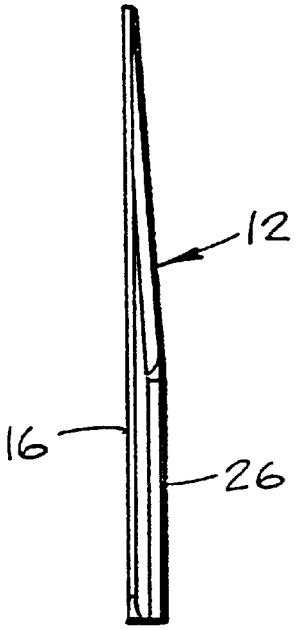
FIG. 7 is a side elevational view of the tray.
Figure 9:
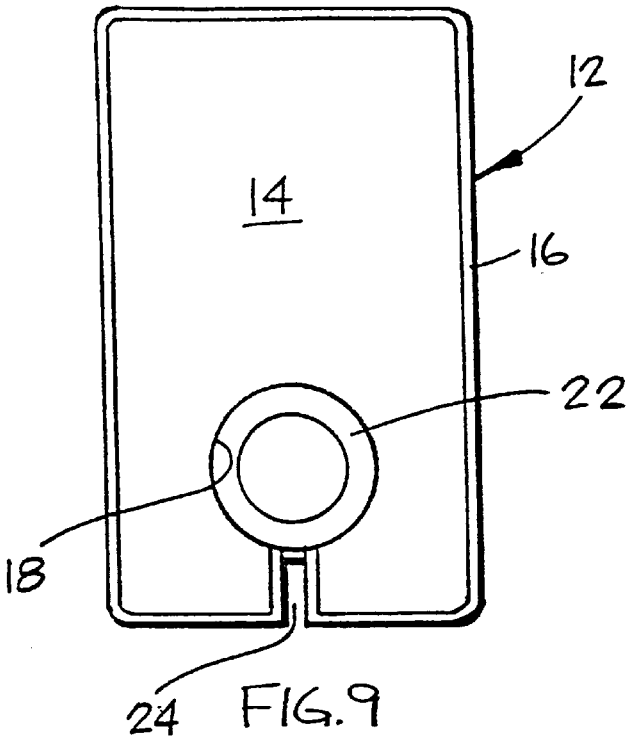
FIG. 9 is a top plan view of the tray.

Housing or tray 12 is shown to constitute a generally rectangular member substantially the size of a credit card, or slightly smaller, having a generally flat inner surface 14, an upstanding low peripheral rim 16 around surface 14, a shallow cylindrical recess 18 in surface 14 having a thin exterior bottom wall 21 (FIG. 3), and having a recessed annular shoulder 22. Annular insulation wafer 44 is placed in recess 18 on shoulder 22, with battery 30 against wafer 44 on its opposite electrical face as depicted in FIG. 3. Tray or plate 12 also has an outer surface 26 preferably tapered toward the two side edges and toward the end of the tray which is opposite the light emitting source 36. This component is preferably generally rigid. Into this outer surface 26 is preferably formed an outer recess 28 (FIG. 3) to leave integral wall 21 relatively thin and readily flexible under finger or thumb pressure, e.g., being about 0.010 to 0.020 inch in thickness. The specific thickness of wall 21 can vary depending on the material of which tray 21 is formed. Housing tray 12 is shown formed of a polymeric material, preferably a one-piece injection molded material, with rim 16 being integral. The polymeric material may be any of resiliently deformable materials such as ABS rubber, polyethylene, polypropylene, or others. Tray 12 also has extending from bottom surface 14 to the outer end wall of tray 12 an elongated generally cylindrical through slot 24 to receive light emitting source 36, particularly a cylindrical LED.

Figure 2:
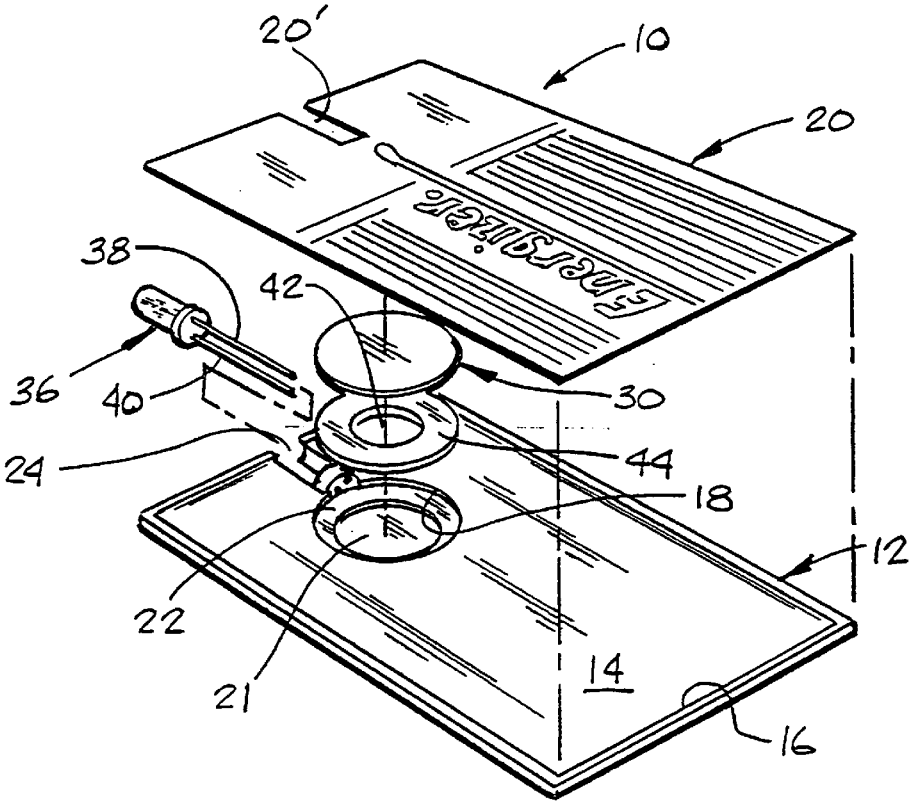
FIG. 2 is an exploded perspective view of the light in FIG. 1.
Figure 8:
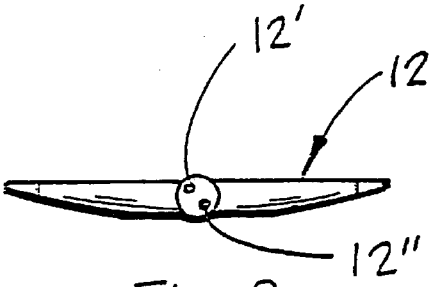
FIG. 8 is an end elevational view of the tray from the opposite end of that in FIG. 6.

The LED has a pair of elongated leads 38 and 40 (FIG. 2) extending from the rear end thereof. These metal leads are inherently resilient. Elongated holes or passages 12' and 12" in tray 12 are vertically offset from each other to receive the LED leads inserted longitudinally from the end of the assembly. Forceful insertion of the LED leads into holes 12' and 12" causes lead 38 to extend into recess 18, engage the cylindrical peripheral wall of the battery, and bend along its periphery to hold the leads and the LED retained in fixed position, and to make good continuous electrical contact with this electrically positive wall of battery 30 (FIG. 8). Lead 40 extends through hole or passage 12" (FIG. 8) and protrudes into recess 18 (FIG. 3) beneath annular electrical insulator 44, i.e., on the opposite side of the separator from the battery to be spaced from the battery, and specifically from the bottom negative surface of battery 30, and to be adjacent wall 21. Lead 40 is thus separated from battery 30 by air space 42 located centrally of insulation wafer or separator 44 so that lead 40 is normally separated from the battery to result in an incomplete circuit. Inward deflection of wall 21 by squeezing (between the finger and thumb of the user) label 20 and wall 21, deflects lead 40 through air space 42 into contact with the negative surface of battery 30 to thereby temporarily complete a circuit from the battery to the LED 36.

Self adhesive label 20 is preferably formed of a waterproof or water resistant cover of material having a suitable adhesive of those known commercially, on its inner surface, this preferably being a typical pressure sensitive adhesive. The label periphery is dimensioned to fit within the bounds of rim 16 on tray 12. Label 20 has an elongated slot 20' which generally coincides with slot 24 in tray 12, i.e., astraddle LED 36. The label is preferably of polymer, paper, laminate, or other basically water resistant, electrically nonconductive material.

Assembly of the novel card light is readily accomplished by placing annular insulation separator 44 into recess 18 so as to rest on shoulder 22, placing the like diameter battery 30 on separator 44, applying label 20 over battery 24 and adhering it to tray 12 within the rim 16, and inserting light source 36 axially, i.e., from the end of the subassembly, to cause leads 38 and 40 to extend into respective holes 12' and 12", causing lead 38 to engage and curvilinearly bend along the one peripheral wall of battery 30, and lead 40 extending adjacent but spaced from the other wall of opposite polarity of battery 30. Lead 40 retains its spaced position from the battery by reason of the air gap 42 formed by separator 44, until wall 21 is deflected inwardly by squeezing wall 21 and label 20 between the thumb and forefinger, thereby deflecting wall 21 sufficiently to force lead 40 into temporary engagement with battery 30. This completes the circuit between the battery and the LED. Upon release of the pressure, the inherent resiliency of the polymeric wall 21 and lead 40 causes them to return to the positions illustrated in FIG. 3, i.e., to open the switch, thereby deactivating the light source.

The simplicity of the card light lends itself readily to high speed manufacture. Further, it is safe and effective, as well as convenient to use or to carry in a wallet or purse, for example. Various other advantages or features may be readily apparent to those in the art.

As an alternative to the shown placement of the battery 30 and spacer 44, the two could be exchanged with each other, as well as lead 40 being positioned vertically between the insulator and label 20, such that the air space is created between the battery and the lead adjacent label 20. Hence, squeezing of the housing and label 20 would cause the label to temporarily deflect in order to bend the resilient lead down through the air space 42 against the battery and complete the circuit.

With the novel assembly, no separate switch is necessary since the lead, the housing wall, and the air gap form a switch mechanism cooperative with battery 30.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A card light assembly comprising:

a generally flat polymeric tray having inner and outer surfaces and a pair of ends, an electrochemical cell-receiving recess in said inner surface, and a LED-receiving recess at one of said ends;

an annular electrical insulation separator and a disc-shaped electrochemical cell in said cell receiving recess, said insulation separator and said disc-shaped cell having substantially the same diameter;

a LED in said LED-receiving recess, said LED having first and second leads, said first lead is in abutment with said cell and said second lead is spaced from said cell by said annular electrical insulation separator; and a pressure sensitive adhesive label over said inner surface, and said cell adhered to said inner surface, to thereby retain said annular electrical insulation separator and said cell between said tray and said label, said tray being flexibly depressible at said annular electrical insulation separator and cell for temporarily pressing said second lead against said cell to energize said LED.

2. The card light assembly in claim 1 wherein said tray includes a pair of holes from said LED-receiving recess to said cell-receiving recess, and said leads extending respectively through said holes.

3. The card light assembly in claim 2 wherein one of said leads engages and is bent on said cell for electrical contact and for retention of said leads in said housing.

4. A card light assembly comprising:

a generally flat polymeric tray having an electrochemical cell-receiving recess with a cell therein, and a light source-receiving recess with a light source therein;

an electrical insulator adjacent said cell;

said light source having first and second leads;

said first lead being in electrical contact with a first side of said cell, and said second lead being normally spaced from electrical contact with a second side of said cell such that said cell and said electrical insulator lie between said first and second leads;

a cover secured over said cell and on said tray wherein said cover is an adhesively attached label;

said tray having a wall adjacent said cell; and at least one of said tray wall and said cover being resiliently flexibly deformable to enable said second lead to be temporarily deflected into contact with said cell to activate said light source.

5. The card light assembly in claim 4 wherein said tray has a pair of passages receiving said leads.

6. The card light assembly in claim 5 wherein said passages extend from said light source-receiving recess to said cell-receiving recess.

7. The card light assembly in claim 4 wherein said tray has an inner surface and said recesses being formed therein.

8. The card light assembly in claim 4 including an electrical insulator between said cell and said second lead to cause said second lead to be spaced from said cell.

9. The card light assembly in claim 8 wherein said insulator has an air space adjacent said second lead, and said second lead being resiliently deflectable through said air space to contact said cell.

10. A card light assembly comprising:

a generally planar polymeric tray having four side edges, outer and inner surfaces, and a light source-receiving recess provided at one of said side edges, said inner surface of said tray having a circular cell-receiving recess spaced apart from said side edges and surrounded by non-recessed portions of said tray;

a disc-shaped electrochemical cell disposed in said cell-receiving recess;

an annular electrical insulator disposed in said cell-receiving recess adjacent said cell and having a central opening therein;

a light source having first and second leads disposed in said light source-receiving recess, said first and second leads extending into said cell-receiving recess such that said cell and said annular electrical insulator are positioned between said first and second leads, with said first lead being in electrical contact with a first side of said cell and said second lead being separated from a second side of said cell by said annular separator; and a label secured over said cell and adhered to said tray, wherein at least one of said tray and said label being resiliently flexibly deformable to enable said second lead to be temporarily deflected through said central opening of said annular separator into contact with the second side of said cell to activate said light source.

11. The card light assembly in claim 10 wherein said tray includes a pair of holes from said light source-receiving recess to said cell-receiving recess, and said leads extending respectively through said holes.

* * * * *